US006244998B1

(12) United States Patent
Hinds

(10) Patent No.: US 6,244,998 B1
(45) Date of Patent: Jun. 12, 2001

(54) PADDED ELASTIC RESISTANCE PUSHUP EXERCISER AND METHOD FOR USE

(76) Inventor: Jon Harrington Hinds, 1211 Rutledge St., #5, Madison, WI (US) 53703

( * ) Notice: Subject to any disclaimer, the term of this patent is extended or adjusted under 35 U.S.C. 154(b) by 0 days.

(21) Appl. No.: 09/540,459

(22) Filed: Mar. 31, 2000

(51) Int. Cl.[7] ..... A63B 21/02
(52) U.S. Cl. ..... 482/126; 482/124; 482/141
(58) Field of Search ..... 482/126, 124, 482/121, 122, 129, 140, 141, 148, 907, 904; D21/692, 691

(56) References Cited

U.S. PATENT DOCUMENTS

| | | | | |
|---|---|---|---|---|
| 2,930,614 | * | 3/1960 | McIntosh | 482/126 |
| 4,251,070 | | 2/1981 | Leseberg | 272/126 |
| 4,335,875 | | 6/1982 | Elkin | 272/70 |
| 4,441,707 | | 4/1984 | Bosch | 272/119 |
| 4,735,412 | | 4/1988 | Prsala | 272/138 |
| 4,789,154 | | 12/1988 | Mattox | 272/94 |
| 4,852,874 | | 8/1989 | Sleichter, III et al. | 272/137 |
| 5,108,096 | | 4/1992 | Ponce | 482/125 |
| 5,295,949 | | 3/1994 | Hathaway | 607/109 |
| 5,328,432 | | 7/1994 | Gvoich | 482/139 |
| 5,421,800 | | 6/1995 | Mullen | 482/141 |
| 5,484,366 | * | 1/1996 | Wilkinson | 482/12 X |
| 5,514,059 | | 5/1996 | Romney | 482/126 |
| 5,518,481 | | 5/1996 | Darkwah . | |
| 5,518,486 | | 5/1996 | Sheeler | 482/139 |
| 5,674,166 | | 10/1997 | Gordon | 482/123 |
| 5,681,248 | | 10/1997 | Vani | 482/10 |
| 5,716,305 | | 2/1998 | Selsam | 482/93 |

* cited by examiner

*Primary Examiner*—Jerome W. Donnelly
(74) *Attorney, Agent, or Firm*—Loyd W. Bonneville

(57) ABSTRACT

A physical exercise device comprising a pair of handgrip assemblies joined by elastic cording enwrapped over most of its length by padding; and a method of use thereof to enhance resistance during the performance of pushups, the method entailing the device's emplacement laterally across the posterior portion of the thorax and then otherwise performing the pushups in a conventional manner.

4 Claims, 3 Drawing Sheets

PADDED ELASTIC RESISTANCE PUSHUP EXERCISER AND METHOD FOR USE

BACKGROUND OF THE INVENTION

1. Field of the Invention

Gymnastic devices; portable exercisers unattached in use.

2. Description of the Prior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term cylindrical cord enwrapping pad (1) might be used in one instance but in another, if meaning is otherwise clear from context, expression might be shortened to cord enwrapping pad (1) or merely pad (1). Any of those forms is intended to convey the same meaning.

The term emplace or any of its forms when used in this application means the joining of two objects or parts so as to unite them in a reasonably easily removable way, such as the cylindrical cord enwrapping pad's (1) connection laterally across the posterior portion of the operator's (100) thorax or that of the operator's (100) hand with the cylindrical strap enwrapping pad (18) of a strapped handgrip assembly (10).

The term attach or fasten or any of their forms when so used means that the juncture is of a more or less permanent nature, such as might be accomplished by bolts, welds or adhesives. Thus it is stated herein that panel strapping (26) is attached to the elastic panel (20).

The word emplace is also consistent in meaning with the word "detachable" as occasionally used in connection parlance but not in this application, since it is derived from the root attach.

Where the term is employed, rigid emplacement connotes the meaning that the object is removable but only with some degree of difficulty, such as might be encountered in separating two parts—for example, an embedded stopper (4) from a hollowed elastic exercise cord end (7).

Employment of the words connect, join, mechanically link or any of their forms is intended to include the meaning of both in a more general way.

The word comprise may be construed in either of two ways herein. A generic term used to describe a given one of a number of specific elements is said to comprise it, thereby characterizing the specific element with equivalency in meaning for the generic term. Thus, the means of joining the elastic exercise cord (2) and handgrip strapping (16) may be said to comprise a connection bar (13), meaning that in the particular instance, the bar (13) is the joining means.

However, the word comprise may also be used to describe a feature which is part of the structure or composition of a given element. Thus, a connection bar (13) may be said to comprise strap channels (15), meaning that the structure of the bar (13) is such as to have those channels (15) as a feature of its (13) structure. The meaning in the respective cases is clear from context, however. Accordingly, modifying words to clarify which of the two uses is the intended one seem unnecessary.

Terms relating to physical orientation such as up, down, higher and lower refer to the positioning of the exerciser in the manner in which it is typically oriented for use. Thus, in the performance of pushups, the operator's (100) hands and arms are spoken of as forcing his (100) or her (100) stiffened body upwards.

The word thorax when used herein designates the portion of the operator's (100) body between the neck and waist.

Numerous exercise devices have emerged in the prior art which require no attachment to independent supports. These have often been referred to as isometric, isotonic, isokinetic and other identifiers. They share the important feature of portability. Most involve stretching each arm outward in expansion against resistance provided by the device in what are known as "chest pulls".

Another category which has proved to be popular involves stretching against resistance emplaced along the back of the neck in what might be designated neck tugs.

Many highly beneficial exercises involve no device at all, of course. One of these is the "pushup" in which the operator (100) lies face down on the floor (200), stiffens his body and raises himself or herself upwards by pressing the palms of his or her hands against the floor (200). Representative of one trend of thought are at least two inventors who provide devices which lessen the force required to accomplish pushups. U.S. Pat. No. 5,421,800 issued to Mullen employs a spring loaded platform and U.S. Pat. No. 5,716,305 issued to Selsam, a spacer block to change the body angle during performance.

Applicant is not alone, however, in considering it important to allow an external force to impede the pushup rather than help it along. The greater exertion required enhances muscle building not otherwise attainable.

Some of the prior art devices employ structures comprising a certain degree of both rigidity and flexibility—that is, one of semi-rigid composition—positioned about a given part of the body to provide the sought after resistance. U.S. Pat. No. 4,789,154 issued to Mattox and U.S. Pat. No. 5,674,166 issued to Gordon are of this sort.

One assembly, that devised in U.S. Pat. No. 5,518,481 issued to Darkwah, provides the elastic enwrapment function de hors a padded cushioning element. While this device might be successfully employed in performing pushups, the absence of padded enwrapment subjects the operator (100) to undesired stresses. For such purpose, the device also comprises an array of cording inconvenient for pushups.

There is also a group of devices which employ the principle of enwrapping a first part of the body with a band or similarly functioning element interconnecting a second part of the body with flexible exercise cord (2). These include U.S. Pat. No. 4,251,070 issued to Leseberg, U.S. Pat. No. 4,735,412 issued to Prsala; U.S. Pat. No. 5,108,096 issued to Ponce; and U.S. Pat. No. 5,518,486 issued to Sheeler.

Along the lines of the devices functioning in the manner just discussed are those in which the enwrapping element comprises sufficient thickness so as to provide cushioning at its site of body contact. They are, therefore, relevant to the performance of pushups, although they do not specifically address that form of exercise. These include U.S. Pat. No. 5,295,949 issued to Hathaway, U.S. Pat. No. 5,514,059 issued to Romney; and U.S. Pat. No. 5,681,248 issued to Vani.

Some of the enwrapment and elastic cord (2) combinations tend toward body harness configuration which could conceivably be adopted in but are not highly material to pushup performance. U.S. Pat. No. 4,441,707 issued to Bosch and U.S. Pat. No. 5,328,432 issued to Gvoich are two of these.

There are also partial body enwrapment configurations which employ nonelastic cording designed to slide freely within cushioning tubing. These include U.S. Pat. No. 4,335,875 issued to Elkin and the Gvoich patent, supra.

U.S. Pat. No. 4,852,874 issued to Sleichter, III, et. al. illustrates a device which resembles some of the foregoing in comprising material along the midlength of its elastic cording (2). However, that element serves other than an enwrapping or cushioning function.

An examination of the foregoing prior art devices readily discloses that their principle of operation requires such increased effort against resistance by parts of the body other than those involved with pushups. Presumably, the application of such a principle to the performance of pushups did not occur to those inventors. As mentioned supra, the only innovations concerning pushups addressed easier-to-overcome devices rather than any which might make them more difficult to perform. In view of that trend, the fact the devices encumbering pushups with increased resistance did not appear is not really surprising. Indeed, not all are capable of performing a pushup correctly against added resistance. As meritworthy as easier-to-overcome devices might be for certain rehabilitative purposes—post hospital recovery, for example—athletic muscle building beyond the norm can be accomplished only by making the exercise task more difficult.

What is needed is a simple, portable unit or assembly which provides resistance the operator (100) performing pushups must overcome. Ideally, a device with which the resistance increases proportionately with the degree of body raising—such as one employing elastic means in a particular way—would be ideal. Such a device, if available, would permit the development of a protocol or method for performing pushups not previously employed.

It would, thus, be highly beneficial to employ devices which have already been developed, such as by that of Vani and others for neck tugging and to shape that device to fit the part of the operator's (100) body employed for the pushup—namely the upper thorax.

Except for a singular consideration, the Vani tubular cushioning cylindrical pillow is well suited to this end. Because the strapped handgrip assembly (16) therein allows the handgrip strapping (16) to pull into a vertex at the point the strapping (16) meets the elastic cord (2), the pushup operator's (100) hands would be subjected to unsatisfactory tension as the pulled straps (16) bite into the sides of the hands. Where pushups are concerned, some means of forcing the straps laterally apart above the back of the operator's (100) hands would be extremely helpful.

Further, while experience demonstrates that a singular cord is, in general, sufficient to withstand the wear pushups bring to bear upon it, the sharing of the pushup resistance load by more than one cord (2) would be an enhancement all the more beneficial in increasing its (2) longevity.

A review of the foregoing patterns of development demonstrates an extensive variety of approaches to the provision of resistance for exercise. Nevertheless, the needs or objectives pointed out supra thus far remain only partly addressed in the prior art. Some, such as that just immediately discussed, have not been met at all.

SUMMARY OF THE INVENTION

The invention comprises both a physical object and a method in its use. As an object, it incorporates an elastic exercise cord (2) and a cylindrical cord enwrapping pad (1), both of which are widely familiar to prior art in one exercise device or another. Strapped handgrip assemblies, in the generic sense, are also common in the art. That (10) employed by the invention, however, comprises a connection bar (13) for each, comprising in turn a cord channel (14) for the elastic cord (2) to pass through and a pair of strap channels (15) for the handgrip strapping (16) to pass through. Nor is the secure connection of cord (2) to handgrip assembly (10), employing an embedded stopper (4) within the elastic cord's hollowed end (7)—currently, a frequent ingredient of many elastic cord (2) assemblies in general—anything new. The cord (2) is merely extended through the cord channel (14) and then, with considerable exertion, the stopper (4) is pushed into the hollowed end (7). At prior art, the elastic cord (2) was typically inserted through an aperture in the strapping (16) as the first step in making this connection. A cylindrical strap enwrapping pad (18), also well known, is present as a sleeve around the part of the strapping (16) the operator (100) grips during use.

Novelty concerning the physical aspects of the invention in part reposes in the connection bar (13), supra, which by reason of its somewhat rectangular configuration, serves to laterally space apart the portion of the strapping (16) the hands grasp. Without the bar (13), the strapping (16) tends to be pulled into a vertex at its (16) juncture with the cord (2) pressing uncomfortably against the sides of the hands as well as subjecting the strapping (16) to unacceptable wear at that point.

One embodiment of the invention comprises a plurality of elastic cords (2) disposed so as to share the force of lateral extension of the handgrip assemblies (10) away from an elastic panel (20) upon which they are rigidly emplaced. The connections of the cord ends (7) to the handgrip assemblies (10) and the panel (20), respectively, is accomplished at each connection point by a connection bar (13). Thus, for three elastic cords (2) extending from each lateral half of the elastic panel (20), there are six connection bars—three on the panel (20) and three on the handgrip assembly (10). The preferable disposition is to orient all of the cords (2) at each side parallel one another.

The methodological aspects of the invention comprise three very simple manipulative steps: Emplacing the cylindrical cord enwrapping pad (1) across the posterior of the operator's (100) thorax; extending the hands through the handgrip strapping (16) in order to grasp the cylindrical strap enwrapping pads (18); and then—in typical pushup fashion—pressing the hands with arms stiffened against the floor (200) and stiffening the body in general with the feet in contact with the floor (200), raising the body angularly. By reason of the resilience provided by the physical assembly described supra, the operator (200) encounters resistance which renders the pushups more difficult to perform than without it but accordingly derives enhanced muscular benefits therefrom. While the method disclosed herein is but a small departure from that undertaken at prior art in performing traditional pushups, that seemingly slight difference between them provides remarkable additional body building results.

BRIEF DESCRIPTION OF THE DRAWINGS

Solid lines in the drawings represent the invention. Dashed lines represent either noninventive material; that not incorporated into an inventive combination hereof; or that which although so incorporated, lies beyond the focus of attention.

DESCRIPTION OF THE PREFERRED EMBODIMENT

Figure 1:
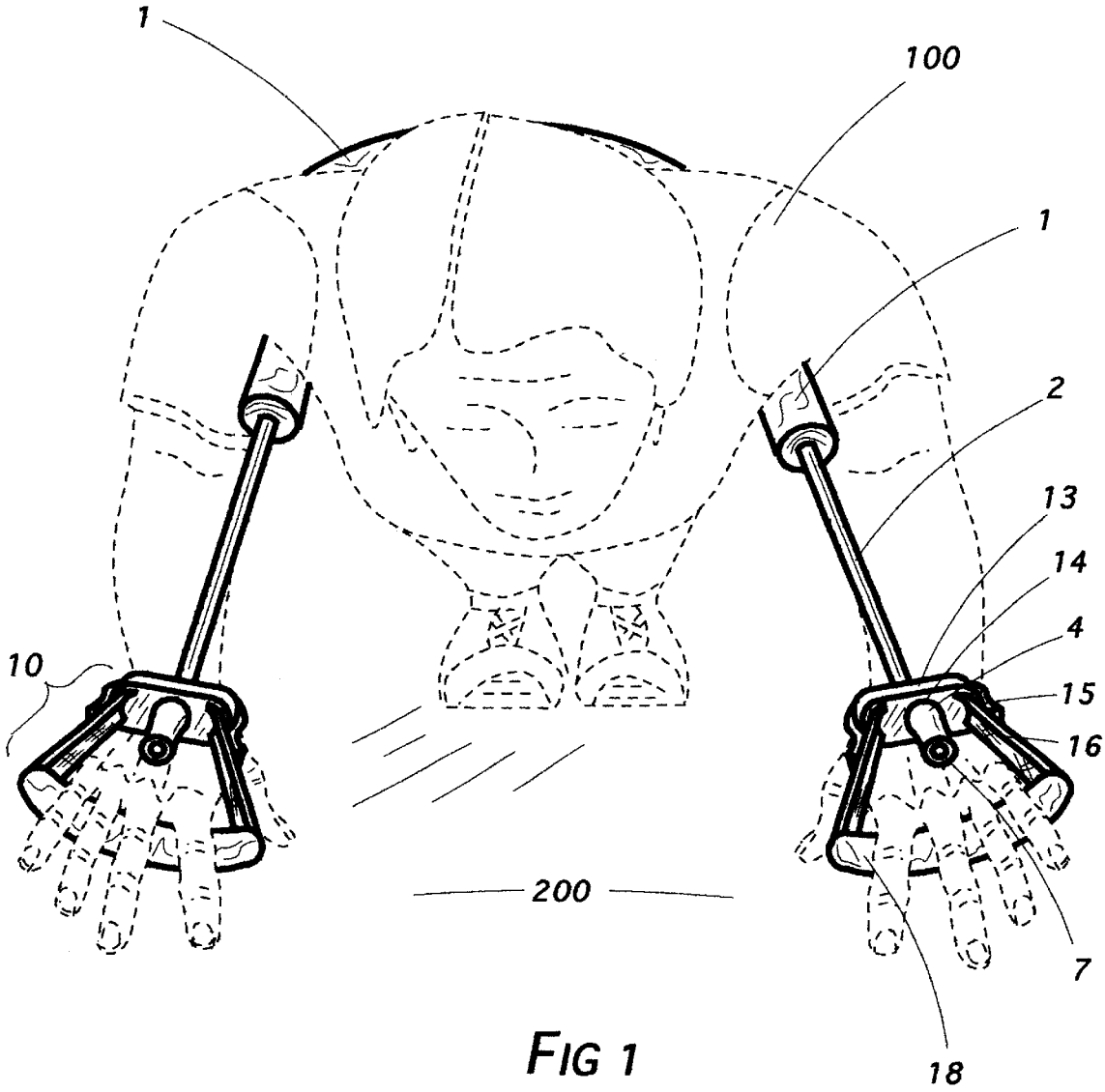
FIG. 1 illustrates the invention's use by an operator (100), showing it laterally enwrapped about the thorax with the elastic cords (2) pulled downward by the hands toward strapped handgrip assemblies (10) pressed upon the floor (200).
Figure 2:
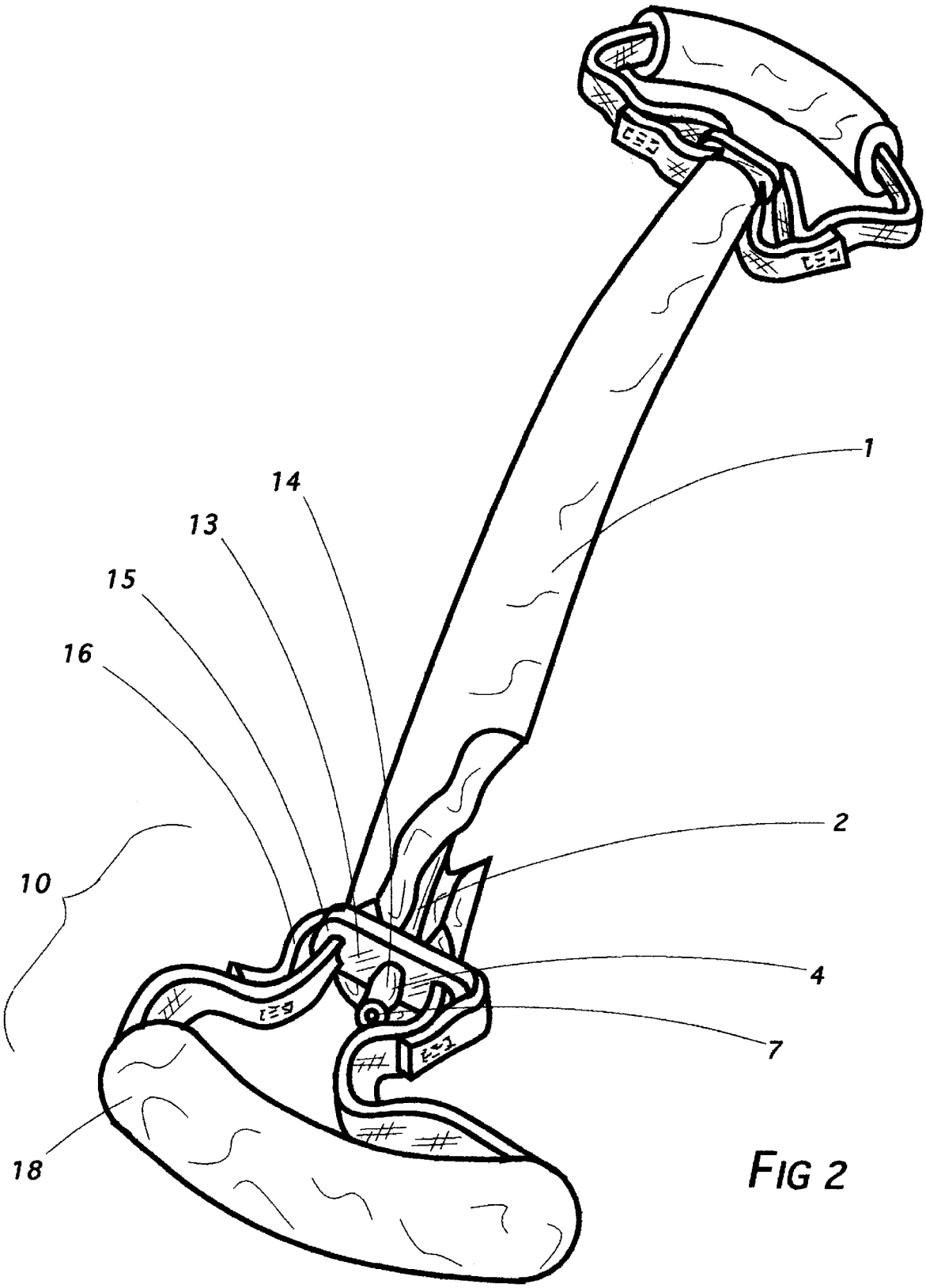
FIG. 2 depicts in perspective a cutaway view of the invention, showing with particularity the components thereof.

The subject of this application comprises what is identified herein as a method of performing pushups employing a padded elastic resistance body exerciser. In the main, with singular exception, the constituents of the device used are known to prior art.

Invention in the Physical Assembly

The device in question comprises in combination an elastic exercise cord (2), a pair of strapped handgrip assemblies (10) and a cylindrical cord enwrapping pad (1).

The elastic exercise cord (2) is well known in the art. A strapped handgrip assembly (10) is disposed at each of the ends of the cords (2). Presently, variations of strapped handgrips are also widely known. The assembly employed herein (10) comprises a connection bar (13), however, which enhances the capacity of the device to offer the sought after added resistance, supra. Additionally, the assembly employed comprises handgrip strapping (16) and a pair of cylindrical strap enwrapping pads (18).

The connection bar (13) comprises a novel ingredient for a strapped handgrip since it not only provides improved means by which the handgrip strapping (16) and the elastic cord (2) may be conveniently and securely interconnected but avoids the cramping effect upon the hands during performance of pushups of a mere apertured strap for connection purposes, supra.

Addressing first the matter of security, the connection bar (13) comprises openings therein identified herein as strap channels (15) through which (15) the ends of the strapping (16) may be inserted and attached. Prior art has fairly well demonstrated in other strapped devices that the preferable means of attachment comprises sewn stitching an inserted fabric strap end back upon itself. Materials other than fabric have also undoubtedly been used and means involving other strap connections such as rivets, grommets or heat welds are also extant.

The connection bar (13) is merely an intermediary between strap (16) and cord (2). The latter (2) must also be securely connected to fully meet requirements. A preferable solution known also in the art involves rigid emplacement of an embedded stopper (4) within an exercise cord (2) which comprises hollow tubular configuration. The stopper (4) preferably comprises the shape of a truncated cone. The insertion of the stopper (4) into the cord's hollowed end (7) is undertaken only after the cord's end (7) has been inserted through an elastic exercise cord channel (14) within the connection bar (13). Once the stopper (4) is so embedded, tugging upon the exercise cord—such as during its intended use—causes the zone of embedding to impinge against the wall of the cord channel (14), making the connection even tighter. Although it is very difficult to remove the stopper (4) from the cord (2), its (4) retrieval is nevertheless possible—for example, in an instance in which the operator (100) wished to shorten the cord (2) by cutting off a portion thereof (2). In view of the attachment of the handgrip strapping (16) and the rigid emplacement of the elastic cord (2) to the connection bar (13), a very satisfactory connection of strap (16) and cord (2) is attained. These prior art means have, therefore, been adopted as a preferable constituent of the physical aspects of the invention.

However, the connection bar (13), configured with a solid, generally rectangularly shape, spaces the oppositely secured portions of the handgrip strapping (16) apart. Were the device to be used for neck tugging exercises or those known in exercise tradition as chest pulls, the lateral displacement of the ends of the strapping (16) would not become a matter of very great concern. The performance of pushups, however, requires that the entire weight of the upper body be disposed upon the hands, which except for fingertip pushups are flatly emplaced against the floor (200). As the shoulders are raised, the straps (16) are pulled to a vertex at their (16) site of connection with the cord (2), configuring them into a narrow elongated triangle, compressing them (16) tightly against the sides of the operator's (100) hands. The strapping's (16) lateral displacement at the connection site avoids such unnecessary impeding stress, supra.

For the uses envisaged for the invention, the handgrip assembly comprises a cylindrical strap enwrapping pad (18). To provide the needs demanded by the stresses upon the operator's (100) hands encountered in using the invention to enhance pushup resistance, the strap enwrapping pad (18) is thick, soft and spongy in configuration. It is preferred that its (1) diametrical thickness comprise about 1-¾ inch, given a tolerance of about ¼ inch one way or the other. The interior passage or tunnel of its (1) cylindrical or tubular construction may comprise diameter of about ½ inch, enough to permit the strap (16) to extend through it (1). Its (1) length must be greater than that of the operator's (100) hand. When used, such as in the performance of pushups, its (1) ends curl upwards along the contour of the operator's (100) hand. Experience demonstrates that its (1) length, therefore, preferably approximate eight inches, give or take about a half inch. The configuration of the strap enwrapping pad (18) is, thus, a significant departure of the handgrips devised in the prior art where different forms of exercise such as neck tugs and chest pulls has been undertaken.

The cylindrical cord enwrapping pad (1), that which is placed against the selected sector of the body the operator (100) intends to exercise—the upper thorax, or more specifically across the shoulders—may be of greater thickness than that of the strap enwrapping pad (18), since it is intended to avoid having the exercise cord (2) bite into the operator's (100) body during the stresses of use. Like the strap enwrapping pad (18), it comprises thick, soft and spongy configuration. It (1) too, configured in cylindrically—that is, in a tubular shape—must comprise an interior tunnel for the elastic cord (2) of approximately ½ inch. Experience has demonstrated that by reason of the pad's (1) soft constituency and the tunnel configuration, the cord (2) is free to slide within it (1) with an acceptable level of sliding friction.

The length of the cord enwrapping pad (1) fills all but about one inch of that of the cord (2) between the handgrip assemblies (10). As was the case with the strap enwrapping pad (18), when the elastic cord is stretched during exercise, its enwrapping pad (1) tends to curl around the contour of the operator's body. Thus, in performing pushups, the pad (1) snugs up against the operator's shoulders, upper thorax or ribs, depending upon its precise positioning. Substantial enwrapping pad (1) length-preferably of the order of about two feet—is, therefore, preferred.

While as mentioned supra, the cord enwrapping pad (1) may comprise exterior diameter greater than that of the strap enwrapping pad (18), for the sake of standardization and economy in manufacture, the two (1, 18) may be cut from the same spongy tubular material.

Figure 3:
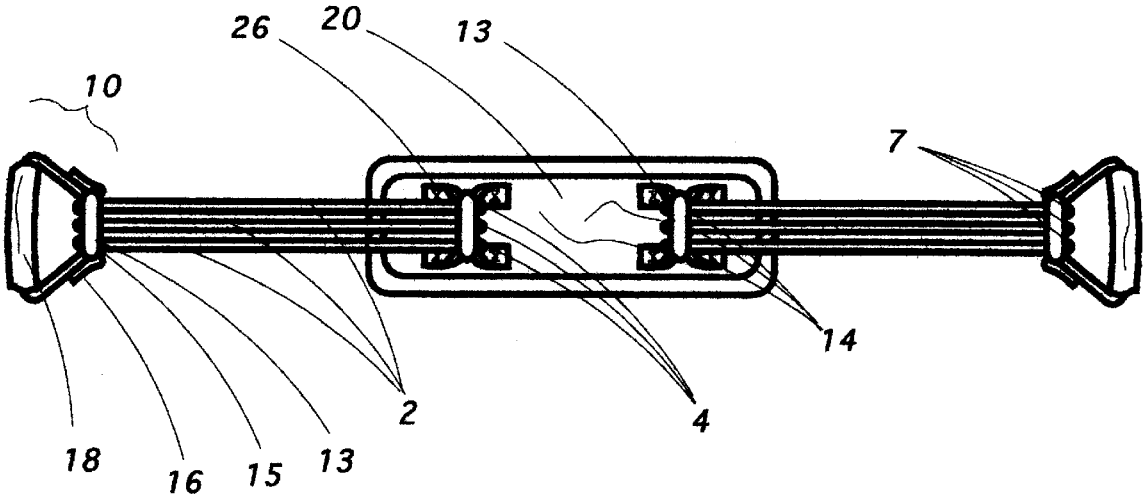
FIG. 3 comprises a view of an embodiment of the invention in which three elastic cords (2) extend from each lateral half of an elastic panel (20) designed for enwrapment about the thorax in the manner discussed herein.
Figure 4:
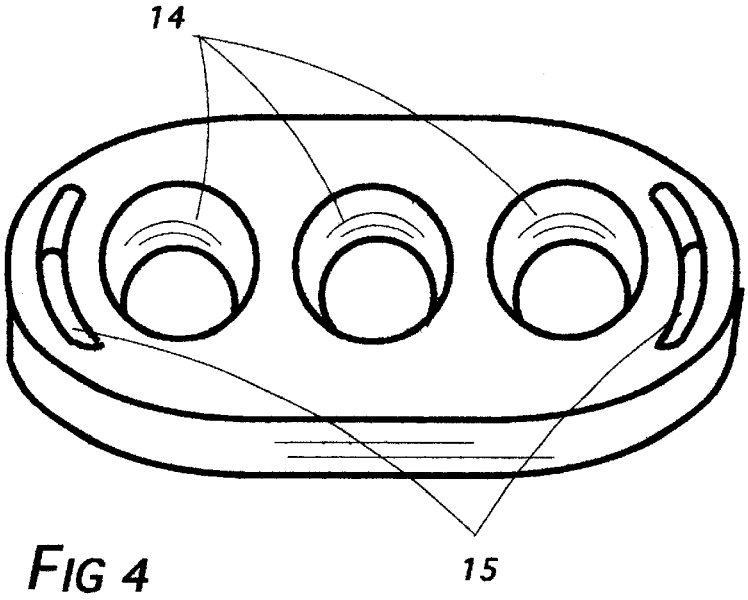
FIG. 4 shows in perspective an embodiment of a connection bar (13) comprising a number of cord channels (14)—three in this case—required in the assembly demonstrated in FIG. 3.

By reason of the connection bar's (13) inclusion, special variations in configuration for the purpose of enhancing resistance while permitting the pulling force to be shared by additional elastic cords (2) are permitted. FIG. 3 illustrates this principle in which first ends of three cords (2) are connected to each side of an elastic panel (20)—often commonly referred to as "webbing"—and second ends thereof (2) to respective strapped handgrip assemblies (10). One connection bar (13) is attached to each respective half of the elastic panel (20) as shown. Each connection bar (13) comprises three cord channels (14) in addition to the strap channels (15) discussed supra. A total of four connection bars (13)—one at each handgrip assembly (10) and two, laterally disposed from one another (13) on the elastic panel (20)—are, therefore, employed. In this embodiment, the elastic panel (20) replaces the cylindrical cord enwrapping pad (1) discussed supra.

The panel may either be of solid elastic material or otherwise composed of a fabric interior overlain with an elasticized medium. Preferably, it (20) comprises a firm, elastic medium such as Neoprene®, a commercially available product.

The means of joining the connection bar (13) to the elastic panel (20) preferably entails attaching to it paired lengths of (20) panel strapping (26) similar to that employed with the handgrip assemblies (10). Since it is feasible to sew the strapping (26) to the panel (20) by traditional stitching, attachment is preferably accomplished in that manner. The panel strapping (26) is then joined to the connection bar (13) in the same manner the handgrip strapping (16) is attached to the connection bars (13) comprised by the handgrip assemblies (10). Thus, the panel strapping (26) is run through the bar's strap channels (15) and attached back upon itself (26). Such attachment, just as stated supra, may comprise sewn stitching, rivets, grommets or heat welds. It is, therefore, stated herein that the connection bars comprised by the elastic panel (20) are attached to the opposing lateral halves of the panel (20), albeit indirectly so.

Invention in the Method of Use

In this particular case, the device itself does not foretell the manner of its use. One might too quickly conclude it should be employed in the undertaking of chest pulls or neck tugs, exercises or rehabilitative endeavors discussed supra. The particularized use addressed herein involves a very simple protocol. For the sake of this discussion, it may in the first instance be assumed that the device employed is in its entirety already a subject of prior art and that the patentable distinctions elicited herein are not present.

In undertaking the inventive method of exercise which is the subject hereof, the operator (100) positions—that is, emplaces—a generically considered padded elastic resistance exerciser in back—or at the posterior—of himself or herself across the upper thorax. While the precise locus of emplacement is a matter of personal selection, applicant considers it preferable that it be emplaced laterally across the back, several inches beneath the top of the shoulders such in use, that each end will be snugged about the back of the higher portion of the thorax and brought underneath the arms as shown in FIG. 1. Although in use, the padded exerciser could conceivably be snugged instead around and over the arms, such emplacement permits it to slip out of place, perhaps sliding forward to rest across the operator's (100) neck. The exerciser is better secured when run or extended beneath the operator's armpits.

The next manipulative step requires extending the operator's (100) hands into the respective left and right strapped handgrip assemblies (10)—that is, inserting the fingers and foremost portion of the palm of each hand through the loop of the handgrip strapping (16)—and grasping with each hand the cylindrical strap enwrapping pad (18) of each respective assembly (10). In some ways, this orientation resembles that involved in undertaking boxing thrusts or punches. Here, however, the operator (100) is pronely situated upon the floor (200) rather than erect and has the palms faced downward away from the body—that is, in traditional pushup posture rather than turned vertically when engaging handgrips.

The final manipulative step is merely that involved when performing the pushup. The operator (100) exerts the hands downward, causing the upper portion of his (100) or her (100) stiffened body to angle upward, the feet remaining in contact with the floor (200). When performing this step, however, part of the palm of the hand contacts the cylindrical strap enwrapping pad (18), which thereby absorbs some of the exerted force as the operator (100) disposes the handgrips in a resistance providing direction. In undertaking this maneuver, however, there is a distinct departure from the traditional pushup in that the operator's (10) upper thorax is forced against the resilience of the padded exerciser. It is a fortunate circumstance that the higher the upper thorax is inclined, the greater the resistance becomes. Such is the nature of elasticity.

The increased resistance provided in undertaking this methodology enhances muscle building of the upper thorax beyond that otherwise possible in the performance of traditional pushups. Although the manipulative steps are simple and few in number, they comprise novel means of attaining the additionally provided benefits.

As mentioned, this method entails the use of any padded elastic resistance exerciser as that generic term is used herein. The physical assembly—that is, the hardware—that is also the subject of this application may also be so employed. By reason of the characteristics of the connection bar (13), supra, even greater satisfaction is derived in following the method of performance featured herein.

The inventor hereby claims:

1. A padded elastic resistance pushup exerciser comprising an elastic exercise cord;

a pair of strapped handgrip assemblies; and a cylindrical cord enwrapping pad;

each handgrip assembly comprising handgrip strapping;

a connection bar; and a cylindrical strap enwrapping pad;

the connection bar comprising a pair of strap channels; and at least one elastic exercise cord channel; the handgrip strapping disposed at each of its respective ends by attachment through the connection bar strap channels; and the elastic exercise cord disposed at each of its respective ends by means of rigid emplacement through a connection bar elastic cord channel;

whereby an operator, by emplacing the cord enwrapping pad across and constraining the upper thorax at the posterior of his or her body, grasping the handgrips and disposing them in a resistance providing direction and exerting his or her shoulders against the constraining pad, may exercise the upper thorax, enhancing the benefits of pushups.

2. The padded elastic resistance pushup exerciser according to claim 1 wherein the elastic cord comprises hollowed tubular configuration and the means of its rigid emplacement through the connection bar's cord channel comprises a stopper embedded within the hollow at each of its ends;

whereby, as the elastic cord is tugged, each of its ends is secured by impingement within the connection bar.

3. A padded elastic resistance pushup exerciser comprising an elastic panel;

four connection bars, one of which is attached to one lateral half of the panel, one attached to the opposing lateral half thereof, one attached within one of a pair of strapped handgrip assemblies and the remaining one attached within the other of the pair thereof;

the elastic panel comprising on each opposing lateral half thereof a pair of panel straps disposed by attachment thereon and the means of attachment of the connection bars to the opposing lateral halves of the elastic panel comprising their attachment in turn to the panel straps attached to the panel;

each connection bar comprising a plurality of cord channels equal in number to that of every other connection bar;

a plurality of elastic exercise cords equal to twice the number of cord channels in each connection bar;

one end of each elastic cord rigidly emplaced within the connection bar of one strapped handgrip assembly and the other cord end rigidly emplaced within one of the connection bars attached to the elastic panel such that one half of the elastic exercise cords interconnect one strapped handgrip assembly to one lateral half of the elastic panel and the remaining half of the cords interconnect the remaining strapped handgrip to the other lateral half thereof;

whereby, upon emplacement of the elastic panel across the posterior of and constraining the operator's upper thorax, the operator's grasping the respective handgrip assemblies and performing pushups against the resistance of the panel and elastic exercise cords, the force load of resilience is shared by the plurality of cords.

4. The padded elastic resistance pushup exerciser according to claim 3 wherein the number of cord channels in each connection bar is three and the number of elastic cords is six.

* * * * *